United States Patent [19]

Darlington

[11] 4,195,616

[45] Apr. 1, 1980

[54] ARCHERY BOW QUIVER MOUNT

[75] Inventor: Rex F. Darlington, Hale, Mich.

[73] Assignee: Darton, Inc., Flint, Mich.

[21] Appl. No.: 910,667

[22] Filed: May 30, 1978

[51] Int. Cl.[2] ..... F41B 5/00

[52] U.S. Cl. ..... 124/24 R; 224/200

[58] Field of Search ..... 124/23 R, 24 R, 88, 124/45; 224/113, 26 R, 5 R, 5 H; 150/1; 403/353; 42/1 ST; 248/222.2, 222.3, 223.3, 73; 339/53; 33/265, 245, 247, 249

[56] References Cited

U.S. PATENT DOCUMENTS

| | | | |
|---|---|---|---|
| 1,520,520 | 12/1924 | Thomason | 403/353 X |
| 1,837,290 | 12/1931 | Redfield | 33/247 |
| 2,338,970 | 1/1944 | Rosenthal | 339/53 |
| 2,464,068 | 3/1949 | Bear | 124/24 A |
| 3,773,734 | 12/1973 | Rose | 124/24 A |
| 4,020,984 | 5/1977 | Morris | 124/24 A X |
| 4,156,496 | 5/1979 | Stinson | 124/23 A |

FOREIGN PATENT DOCUMENTS

| | | | |
|---|---|---|---|
| 2248278 | 4/1973 | Fed. Rep. of Germany | 339/53 |

*Primary Examiner*—William R. Browne

*Attorney, Agent, or Firm*—Barnes, Kisselle, Raisch & Choate

[57] ABSTRACT

A quiver holder for archery bows which includes a small attachment plate permanently fastened to a bow handle and a quick attach-detach lug and socket arrangement on a bow quiver to cooperate with the attachment plate requiring no screws or bolts or other fastening device to secure the quiver.

4 Claims, 5 Drawing Figures

ARCHERY BOW QUIVER MOUNT

This invention relates to an Archery Bow Quiver Mount and more particularly to a quick attach-detach mount for a bow quiver which requires no manual manipulation of screws, nuts or bolts.

In hunting with an archery bow, it is convenient to have a quantity of arrows readily available to the archer for fast reload. Thus, open rack quivers have been used which are attached to the bow on the side opposite the sight window. Many of these quivers are attached in such a way that it is necessary to unscrew or unbolt the mount to remove the quiver. In target practice or in hunting, it is sometimes desirable to remove the quiver, but this is a tedious process and may cause delay when it is least desired.

The present invention is directed to a quiver mount which is rigid and secure but which can be quickly attached or detached at the will of the archer by a simple motion. The object of the invention, therefore, is to provide a secure quiver mount which can be attached or detached with one hand in a brief interval and a mount with no loose parts which can get lost or mislaid.

Other objects of the invention will be apparent in the following description and claims in which the invention is set out in a manner to enable those skilled in the art to practice it, all in connection with the best mode presently contemplated for the invention.

Figure 1:
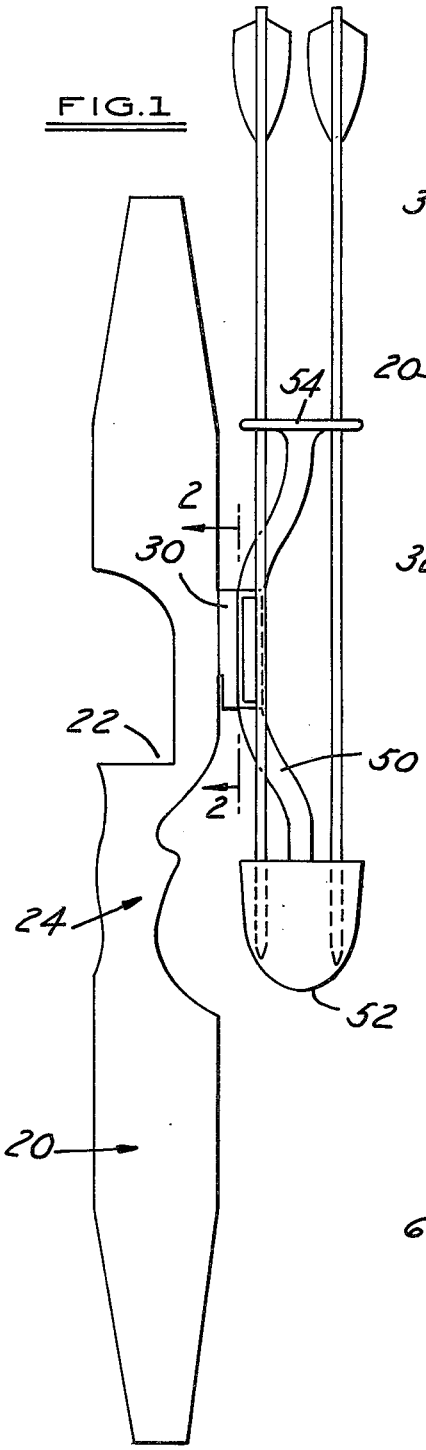

DRAWINGS accompany the disclosure, and the various views thereof may be briefly described as:

FIG. 1, a view of a bow handle and the attached quiver from the archer side of the bow.

Figure 3:
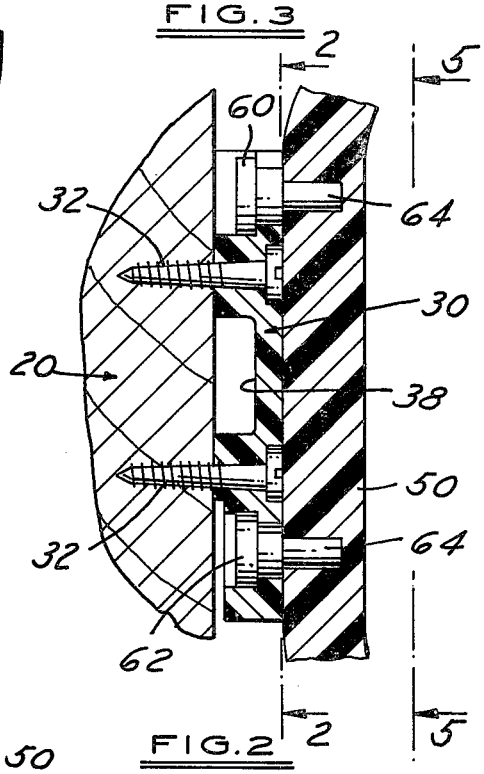
Figure 2:
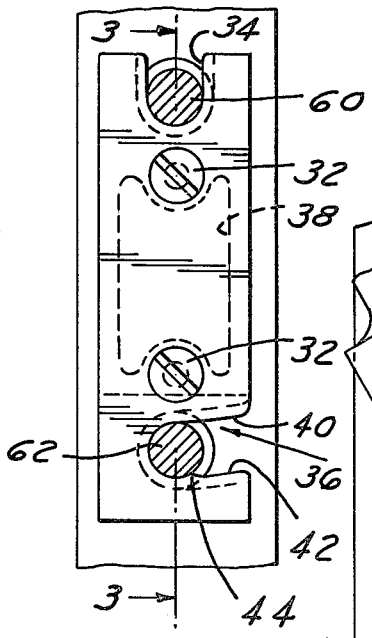

FIG. 2, a sectional view on line 2—2 of FIGS. 1 and 3.

FIG. 3, a sectional view on line 3—3 of FIG. 2.

Figure 4:
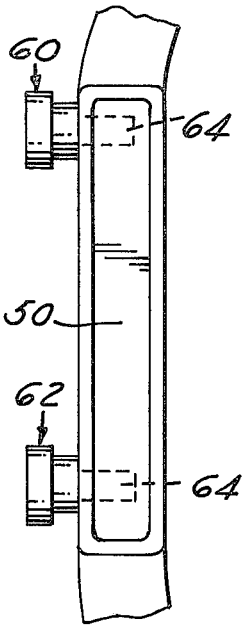

FIG. 4, a side elevation of the quiver attachment.

Figure 5:
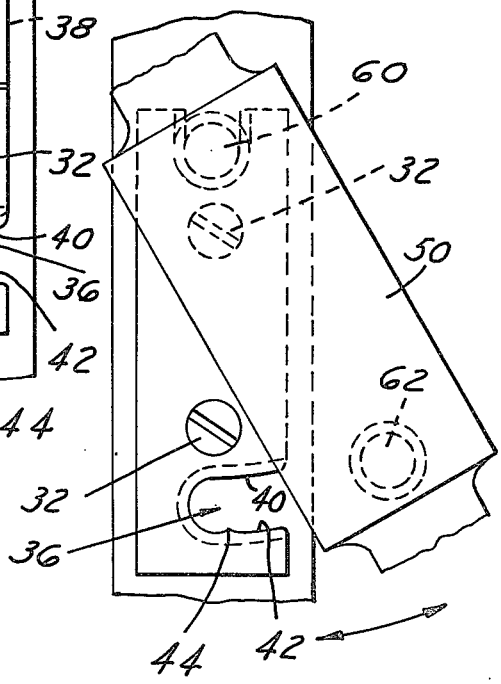

FIG. 5, a side view on line 5—5 of FIG. 3 showing the attachment or detachment motion.

FIG. 1 illustrates a bow handle 20 without the flexing arms. The sight window 22 is positioned on the left between the upper and lower ends of the bow and the grip is shown at 24. To the right and just above the lower part of the sight window is mount plate 30 made from a molded plastic of dense material transfixed by mounting screws 32 having heads countersunk in the outer surface of the plate and screwed into properly prepared holes in the bow handle.

The plate 30 has an open ended recess 34 shown in FIG. 2 at the top central area of the plate and a side recess 36 in the lower right hand side. Each recess has a reentrant portion enlarged from the recess itself. This is shown in dotted lines in FIGS. 2 and 5 and in cross-section in FIG. 3. The central recess 38 is provided simply to save material and lighten the plate. The recess 36, as shown in FIGS. 2 and 5, has an upper surface 40 and a lower surface 42 which are preferably swung on an arc from the center of the upper notch or recess 34. Also, a slight detent rise 44 is provided in the lower surface 42.

The quiver, FIG. 1, to be attached to the bow has a curved body member 50 which bows outwardly at each end to support, at the bottom end, a cup 52 and, at the upper end, a notched plate 54 which receives the shafts of arrows supported point down in the cup. The central portion of the body member 50 has formed thereon two double headed pins 60 and 62. The pins may be formed of a metal such as aluminum with the shanks 64 embedded securely in the body 50, or the pins may be molded integrally with the body 50 of the same material so that they project from the body in the same manner as the pin shown in FIG. 4. These pins are dimensioned to interfit with a reasonably close fit with the recesses 34 and 36, the smaller portion of the head fitting in the smaller portions of the recesses and the larger head portions fitting in the reentrant portions of the recesses.

In assembly, for example, the top pin 60 is dropped into recess 34 with the quiver at an angle as illustrated in FIG. 5. The quiver is then rotated in a clockwise direction so that pin 62 swings in a radius around the top pin and into recess 36. The plastic parts are resilient enough that the detent rise 44 will give enough to allow the lower pin to snap into the base of recess 36.

In this manner, the quiver is quickly secured on the bow handle. Removal simply requires a counterclockwise rotation of the quiver to release the lower pin and permit removal of the top pin. With the quiver removed, the bow has only the small plate 30 permanently attached.

The fit between the pins and the recesses can be reasonably snug since the elongate body of the quiver provides an easy grip and ample leverage to lock in and release the quiver asssembly.

What I claim is:

1. In an archery bow and quiver combination,
   (a) an archery bow having a central handle portion with a relatively flat side surface opposite the sight window,
   (b) an elongate generally rectangular plate having an inner surface and an outer surface, the inner surface being secured to said side surface with the plate disposed in a direction longitudinally of the bow and said plate having a top edge and a side edge conjunctive at one corner of the plate, said top edge and said side edge having notches formed therein spaced from each other, and each having a re-entrant portion inwardly of the outer surface of said plate,
   (c) a quiver having a body portion with a face surface to lie adjacent the outer surface of said plate in attached position, and
   (d) a pair of headed pin extensions projecting from said face surface spaced from each other in the same dimension as said plate notches are spaced, wherein engagement of one of said headed pins with the notch in the top edge of said plate provides a pivot bearing for said plate whereby said second pin may swing into and be retained in said notch in said side edge of said plate.

2. A combination as defined in claim 1 in which the notch in the side edge is disposed on an arc having a center at the notch in the top edge.

3. A combination as defined in claim 1 in which said side notch is formed of slightly resilient material and has a reduced section to retain said second pin when forced past said reduced section.

4. A combination as defined in claim 1 in which said plate is formed of molded, slightly resilient plastic and said side notch has a reduced section to retain said second pin when forced beyond said reduced section.

* * * * *